United States Patent [19]

Blatz

[11] Patent Number: 4,479,634

[45] Date of Patent: Oct. 30, 1984

[54] JACKABLE PROP

[75] Inventor: Rienhold J. Blatz, Alberta, Canada

[73] Assignee: Lyrone Kelsey Industries Ltd., Alberta, Canada

[21] Appl. No.: 526,814

[22] Filed: Aug. 26, 1983

[30] Foreign Application Priority Data

Jun. 23, 1983 [CA] Canada ..... 431116

[51] Int. Cl.[3] ..... B66F 3/00

[52] U.S. Cl. ..... 254/133 R; 248/354.5

[58] Field of Search ..... 254/DIG. 1, 2 B, 8 B, 254/133, 134; 269/17; 248/354 P

[56] References Cited

U.S. PATENT DOCUMENTS

| | | | |
|---|---|---|---|
| 1,292,823 | 1/1919 | Livesay | 254/133 R |
| 2,852,229 | 9/1958 | Gross | 254/134 |
| 2,867,409 | 1/1959 | Southerwick | 254/2 B |
| 3,028,145 | 4/1962 | Brand | 254/134 |
| 3,035,812 | 5/1962 | Wineteer | 254/89 R |
| 3,073,570 | 1/1963 | Harvey | 254/134 |
| 3,271,006 | 9/1966 | Brown et al. | 254/89 R |
| 3,834,669 | 9/1974 | Reid | 254/133 |

FOREIGN PATENT DOCUMENTS

| | | | |
|---|---|---|---|
| 557536 | 5/1958 | Canada | 254/2 B |

*Primary Examiner*—Robert C. Watson

*Attorney, Agent, or Firm*—Birch, Stewart, Kolasch & Birch

[57] ABSTRACT

A novel jackable prop or stand is provided herein. It includes a base including a transverse plate and a pair of widely-spaced-apart, forwardly-projecting feet. A pair of spaced apart, upstanding polygonal cross-section e.g. square, posts are secured to the jackable or stand prop, e.g. either to the transverse plate at the region of the forwardly projecting feet, or directly to an associated foot. A freely-vertically-movable lifting frame is slidably but not relatively rotatably mounted on the posts. The lifting frame includes: (i) a pair of bushing, each bushing having a cross-section similar to that of its associated post, each bushing having a length-to-width ratio of about 4-to-1, and being freely but not relatively rotatably slidably mounted on a respective post, each such bearing thus being precluded from slewing with respect to its associated post and also being inhibited from twisting and jamming when sliding with respect to its associated post; (ii) a transverse bar interconnecting the bushings; (iii) a forwardly projecting load bearing lifting arm, e.g. projecting forwardly from each of the bushings, or from the transverse bar; and (iv) engagement means or associated with the transverse bar, the engagement means being adapted to be engaged by disengageable operable elevating means, whereby operation of the disengageable elevating means causes the transverse bar, and hence the load bearing lifting arms to be raised and lowered against a load applied directly thereon. The prop also includes manually operated means independent of the elevating means and cooperating between each such bushing and its associated upstanding post, e.g. pins adapted to be inserted through aligned holes in the posts and bushings for holding the lifting frame at a predetermined raised vertical position on each associated post after the lifting frame has been so raised and upon disengagement and removal of the elevating means out of engagement with the engagement means. The jackable prop is adapted to be used with a mechanical or hydraulic jack which is adapted to be removable disposable between the base and the engagement means for raising the lifting frame relative to the base. A safe, reliable, rugged and versatile jackable prop or stand is thus provided.

15 Claims, 10 Drawing Figures

JACKABLE PROP

BACKGROUND OF THE INVENTION

1. Field of the Invention

This invention relates to a novel jackable prop, i.e. a device which can be raised to its elevated height by an elevating means e.g. a jack to prop up or raise another device, e.g. a car, tractor, etc., then is locked at that height, to permit removal, then, of the elevating means.

2. Description of the Prior Art

Conventional lifting devices are called jacks and serve the dual function of lifting vehicles or equipment and of holding them in an elevated position. Because the requirements of a lifting device are not necessarily the same as those for a stable device for holding the vehicle at such elevated position, most of the prior art has been directed towards a compromise involving improvements in the jacking device per se.

Base structures which are alleged to provide a stable jacking device have thus been proposed. In U.S. Pat. No. 2,778,597 patented Jan. 22, 1957 by F. C. Haumerson, the patentee provided a thrust bar supporting structure, e.g., a base structure that may be used to support the lower end of the vertical post or rack bar in an automobile jack. The patent device was a two-piece structure consisting of an arched member or plate having an opening at the apex of the arch and a socket clamped to the portions of the plate surrounding the opening and in alignment with the opening so that it may receive the end of the thrust or rack bar. The socket was of a novel construction whereby portions thereof engaged opposite surfaces of the plate around the opening so that a tight grip of the socket on the plate was obtained. This engagement between the socket and plate was sufficient to maintain them in assembled relation and to transmit load from the socket to the plate. A spring wire clip of round cross section was used for yieldably holding the post or bar in the socket.

On the other hand, U.S. Pat. No. 2,924,418 patented Feb. 9, 1960 by E. J. Nolan et al provided supporting devices, e.g., a supporting tool for the temporary support of a body in a position out of its normal position to permit access under and around the supported body and the quick and easy return or reinstallation of the supported body to its normal position. The patented supporting tool was composed of a base plate, and an upstanding stanchion secured to one face of the plate and against relative movement thereto. A depending connector was secured to the plate and projected from the opposite face thereof for engagement with supporting structure. A bracket was slidably mounted on the stanchion. An upstanding connector was carried by the bracket and included means engaging and fixedly securing a body against movement relative to the bracket. A link was pivotally connected at one of its ends to the bracket in opposition to the connector and terminated in a lateral projection having a depending lug. A plurality of spaced complemental slots in the stanchion received and retained the projection and lug, thereby locating the bracket in a selected position on the stanchion and also retaining the bracket in such position. A retaining pin was provided for releasably holding the projection and lug in the selected position.

U.S. Pat. No. 2,958,508 patented Nov. 1, 1960 by M. Martinez provided a jack to lift heavy equipment. The patented jack included a center post, the center post being composed of a pair of vertical, channel-shaped members having vertical, parallel, spaced webs and aligned flanges extending outwardly from one another. A top plate was welded to the upper ends of the vertical channel-shaped members, and a bottom member was welded to the lower ends of the vertical channel-shaped members. Transverse members aligned with one another and were disposed within the channel-shaped members of the center post and welded thereto. Outwardly inclined apertured ears were welded to the ends of the transverse members and upwardly and inwardly diagonal legs were bolted to the apertured ears. Ears were welded to the flanges of the vertical channel-shaped members above the bottom member, and apertured ears were welded to the legs above their lower ends. Links interconnected each pair of adjacent legs by bolts passing through the apertured ears at the lower ends of the legs. Diagonal links interconnected the ears at the lower ends of the legs with the ears at the lower ends of the channel-shaped members. A slider was slidably mounted between the vertical channel-shaped members of the center post and means on the center post to raise the slider.

U.S. Pat. No. 2,970,810 patented Feb. 7, 1961, by J. H. Zich et al provided jack stands of the type used as a third support for a two wheel vehicle when parked. The patented jack stand was composed of a vertically extending sleeve member secured to the vehicle. A supporting post was vertically slidable within the sleeve member and had an extended, ground-contacting lower end, the sleeve member and the post being provided with a plurality of vertically spaced transverse holes. A jacking lever having a fulcrum pin adjacent one end thereof and was insertable in any one of the series of holes in the spot. A generally horizontal jacking surface was provided adjacent the lower end of the sleeve member and was engaged by the fulcrum pin end of the lever. A pin was insertable through the holes in the sleeve member and post to lock the post and sleeve.

U.S. Pat. No. 3,271,006 patented Sept. 6, 1966, by C. H. Brown et al provided, a vehicle lifting system used to elevate a motor vehicle above the ground or other working surface so that repairs or maintenance may conveniently be accomplished on the underside of the vehicle. The patented portable lifting system was for use on a floor having clamp receiving means was composed of a frame with a vehicle engaging means mounted for vertical movement upon the frame. A pair of horizontally disposed legs were connected to the frame. A clamp support plate was connected between the legs, and a clamp was slidably mounted on the support plate between the legs so as to be adapted releasably to engage the clamp receiving means.

U.S. Pat. No. 3,313,505 patented Apr. 11, 1967 by W. E. Petrie provided a collapsible stand, having at least three legs. The patented collapsible stand was composed of an upright member, with at least three legs secured to the upright member above the lower end thereof and extending outwardly and downwardly therefrom, the lower end thereof and extending outwardly and downwardly therefrom, the lower ends of the legs being below the lower end of the upright member. Flexible elongated brace means interconnected each of the legs and the upright member for bracing the legs with respect to the upright member and each leg with respect to adjacent legs.

U.S. Pat. No. 3,848,851 patented Nov. 19, 1974 by Murray A. Elias provided a jacking device suitable for use in the construction industry. The patented jacking device was composed of a first tubular member, a second tubular member telescopically mounted within the first tubular member and projecting outwardly from one end of the first tubular member and adjustment means for adjusting the position of the second tubular member with respect to the first tubular member. The adjustment means included a bracket member and a lever member, the bracket member having an inner end and an outer end. Fulcrum means pivotally mounted the lever member with respect to the bracket member with a first end of the lever member projecting outwardly from one side of the fulcrum means and a second end of the lever member projecting outwardly from the other side of the fulcrum means. The outer end of the bracket was adapted to engage one end of the first tubular member to support the bracket means in a position with the fulcrum means spaced outwardly from the first and the second tubular means. A plurality of longitudinally spaced passages opened inwardly of the second tubular member for engaging the first end of the lever, so that the second tubular member could be telescoped with respect to the first member in response to movement of the second end of the lever about the fulcrum means. Means were provided for locking the first tubular member with respect to the second tubular member to prevent inward telescoping of the second member with respect to the first member.

U.S. Pat. No. 3,802,658 patented Apr. 9, 1974 to Kenneth W. Binding provided a jack stand. The patented jack stand was composed of a rigid hollow column adapted to be supported at one end in an upright position with a post telescopically mounted at the upper end of the column for extension relative thereto, the column containing inclined guideways below its upper end. A first part was supported in an operative position by the guideways, the first part being adapted to be displaced laterally in the guideways to permit extension of the post relative to the first part for re-engagement of another notch therewith, the first part also being adopted to be returned to its undisplaced position when confronted by another notched portion of the post. A second part was supported at the top of the column on its upper end, the second part being adapted in its operative position to have engagement with a notch at the top of the column when a notch lower down was engaged with the first part and to be displaced in an operative position of disengagement from the notch at the top of the post when the post was extended. Means were operable by lateral displacement of the first part to effect a coincidental lateral displacement of the second part. Spring means were associated with the last means and were operable to return the first and second parts to their operative positions.

U.S. Pat. No. 4,021,012 patented May 3, 1977 to Jack V. Miller provided a jack stand. The patented jack stand was composed of a pair of legs, each leg including a portion extending laterally to provide a base for support of the jack stand when the legs were spread partially apart. Means pivotally mounted the legs to move to a position generally adjacent to each other, outward to an extreme support position. The upper ends of the legs defined inwardly extending teeth in spaced opposite juxtaposition within the aperture. A tubular member was dimensioned to pass through the aperture with the surface of the tube member in close proximity to the teeth, the tube member including recess portions interlocking with the teeth when the upper portion of the legs were positioned defining the aperture. The upper end of the tube included means for holding a load.

U.S. Pat. No. 4,042,202 patented Aug. 16, 1977 to Delmo C. Molinari provided a jack stand. The patented jack stand was composed of a first generally upright tubular member, the first tubular member having means for defining a base for resting on a horizontal surface, and having first and second holes through opposite sides of the first tubular member adjacent the upper end thereof for receiving a pin, the region of the first tubular member surrounding the first and second holes being formed outward from the inner surface of the first tubular member, each of the first and second holes having a cross-section having a circular portion and a slot-like portion. A second generally upright tubular member was coaxial with and was slidable within the first tubular member, the second tubular member having means adjacent the upper end thereof for engaging and supporting a part of an automobile, the second tubular member further having a plurality of horizontally disposed through holes, each at one of a plurality of elevations and each generally alignable with the first and second holes in the first tubular member. A pin was provided for extending through the horizontally disposed hole in the first tubular member and any of the horizontally disposed holes in the second tubular member to retain the first and second tubular members in a selected relative axial disposition, the pin having at least one protruding region adjacent one end thereof for fitting through the slot-like portion of the first and second holes in the first tubular member.

Canadian Pat. No. 578,052 issued June 23, 1959 to J. M. Johnson provided a mobile lifting aoparatus including a portable base including a pair of side rails connected by a transverse stationary member and a movable transverse member. A transverse support was carried by the rails. A strut was pivoted to the transverse support. A vertically movable work supporting frame was pivoted in a cantilever fashion to the strut. Work supporting means were carried on the frame. Means were provided for releasably interlocking the transverse support with the movable member. Manually operable means were interposed between the frame and the strut for raising or lowering the frame by changing the angularity between the main frame and the strut.

Canadian Pat. No. 858,966 issued Dec. 22, 1970 to D. A. Haynes provided a vehicle lift having a pair of hoist posts, and runways connected to the posts. The connections allowed both lateral and skewry movement of the runways relative to the post. Locking means locked the runway in its lateral position while permitting skewry movement.

Canadian Pat. No. 939,326 issued Jan. 1, 1974 to C. P. Harrah provided a jack assembly including a wheeled platform and an upwardly extending jack standard. A lever-actuable lift frame was arranged from vertical reciprocation on the standard the lift frame having a forwardly projecting lifting hook. The wheels were pneumatically operated to hold the bottom of the jack out of contact with a support surface until a predetermined load has been applied to the jack.

Canadian Pat. No. 966,477 issued Apr. 22, 1975 to J. Berg provided a shoring jack including a piston and cylinder unit. A collar was disposed between the piston and the cylinder. An abutting element was provided for location on the piston. Hole and pin means were provided to locate the abutting element on one of several positions along the piston.

SUMMARY OF THE INVENTION

Aims of the Invention

In spite of these patents, there is still the need for a simple rugged jackable prop or stand of secure construction and safe and stable in operation.

It is an object of this invention to provide a jackable prop or stand which will not require extensive manipulation to place it in operative position.

Another object of this invention are to provide such a jackable prop or stand which is of relatively simple construction, which embodies a high degree of stability, and which is designed to be easily assembled both to facilitate manufacture and use.

Another object of this invention is to provide an improved jackable prop or stand for a temporary support of vehicles.

Another object of this invention is to provide such an adjustable jackable prop or stand which is durable, rigid and inexpensive.

Still another object of this invention is to provide such an adjustable jackable prop or stand which is dependable and of light weight.

Yet another object of this invention is to provide an improved vehicle lifting system utilizing a jackable prop or stand.

Another object of this invention is to provide such a vehicle lifting apparatus which is portable but which may be stably supported by a support surface or floor.

Another object of this invention is to provide such an apparatus which may be quickly set up or disassembled and which shall be rugged, strong and durable and capable of lifting heavy truck bodies which is relatively inexpensive to manufacture, and which is relatively inexpensive to a high degree in use.

Statement of Invention

By this invention, a jackable prop is provided comprising (a) a base including a transverse plate and a pair of widely spaced-apart, forwardly-projecting, feet; (b) a pair of spaced-apart posts each having a polygonal cross-section upstanding from the base; (c) a freely-vertically-movable lifting frame slidably but not relatively rotatably mounted on the posts, the lifting frame comprising: (i) a pair of bushing, each having a similar polygonal, cross-section, each bushing having a length-to-width ratio of at least about 4-to-1 and being freely but not relatively rotatably slidably mounted on a respective post, each such bushing thus being precluded from slewing with respect to its associated such post and also being inhibited from twisting and jamming when sliding with respect to its associated such post; (ii) a transverse bar interconnecting the bushings; (iii) a forwardly projecting load bearing lifting arm and (iv) engagement means secured to the transverse bar, the engagement means being adapted to be engaged by disengageable operable elevating means, whereby operation of the disengageable elevating means causes the transverse bar, and hence the load bearing lifting arms, to be raised against a load applied directly thereon; and (d) manually operated means independent of the elevating means and cooperating between each such bushing and each such associated upstanding post for holding the lifting frame at a predetermined raised vertical position on each associated post after the lifting frame has been so raised and upon disengagement and removal of the elevating means out of engagement with the engagement means.

Other Features of the Invention

By a feature thereof, the upstanding posts are secured to the transverse plate at the region of the forwardly-projecting feet.

By another feature thereof, the upstanding posts are each secured to a respective, forwardly-projecting foot.

By yet another feature thereof, the lifting frame includes a lifting arm projecting forwardly from each bushing.

By still another feature thereof, the lifting frame includes a pair of spaced-apart lifting arms, projecting forwardly from the transverse bar.

By a feature thereof, the engagement means comprises a hollow engagement member on the lower surface of the transverse bar.

By another feature thereof, the holding means comprises the combination of a plurality of vertically spaced-apart apertures through the bushings and the posts and a pin adapted to be inserted through aligned such apertures.

By a further feature thereof, the jackable prop includes fixed heels projecting rearwardly from the rear of the transverse plate to assist in stabilizing the prop.

By yet another feature, the jackable prop includes rotatable wheels projecting rearwardly from the rear of the transverse plate, both to assist in stabilizing the prop and to enable it to be more easily moved.

By one feature thereof, the cross-section is square.

By a further feature thereof, all elements are of hollow square cross-section.

By another feature thereof, the jackable prop includes a lower step adapted to support the base of an elevating means.

By another feature of this invention, the jackable prop described above includes a lower step adapted to support the base of an elevating means and is provided in combination with (e) elevating means adapted to be removably disposable between the step and the engagement means for raising the lifting frame relative to the base.

By a feature thereof, the elevating means may be either a mechanical jack or an hydraulic jack.

BRIEF DESCRIPTION OF THE DRAWINGS

In the accompanying drawings.

DESCRIPTION OF THE PREFERRED EMBODIMENTS

Description of FIGS. 1–4

Figure 1:
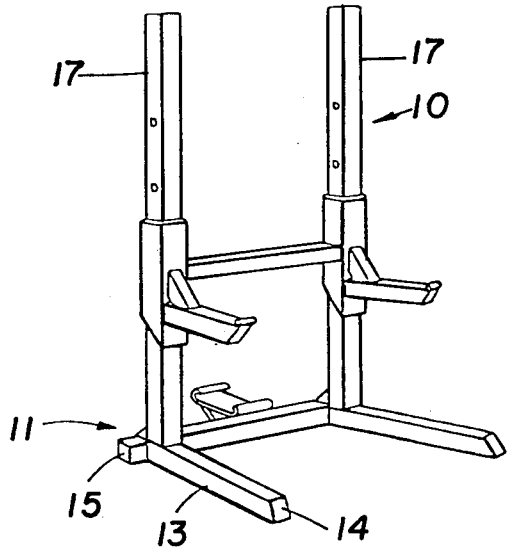
FIG. 1 is a perspective view of the jackable prop or stand of one embodiment of this invention.

As shown in FIGS. 1–4, the jackable prop or stand 10 includes a base 11 constituted by a transverse plate 12 supporting a pair of spaced apart feet 13. Each of the feet 13 includes a long, forwardly extending shoe 14 and a short, rearwardly extending heel 15. The heel 15 may be provided with freely rotatable wheels 16 to assist in transportation of the jackable prop or stand 10. Upstanding from the juncture of the plate 12 and each foot 13 is a respective post 17 of polygonal, e.g. square, cross-section. Projecting rearwardly from the transverse plate 12 at approximately its mid point is a step 18 whose purpose will be explained hereinafter.

A freely vertically movable lifting frame 20 is slidably mounted with respect to the posts 17. The frame 20 comprises a pair of bushings 21 each having a cross-section similar to the cross-section of the post 17 so that it is precluded from slewing while being freely slidably mountable relative to an associated post 17, the bushings 21 being interconnected by a transverse bar 22. As seen in the drawings the bushings 21 have a length-to-width ratio of at least about 4-to-1, so that each of the bushings 21 is inhibited from twisting and jamming when sliding with respect to its associated post 17. Projecting outwardly from each bushing is a lifting arm 23, the upper surface 24 of each lifting arm 23 being coextensive with the upper surface 25 of the transverse bar 22. At the lower surface 26 of the transverse bar 22 at approximately its mid point is an engagement member 27 whose puspose will be explained hereinafter. The lifting arms 23 are each preferably braced by angle fillet 28, e.g., by link chain 29, is a pin 30. The pin 30 is adapted to be selectively placed in a selected one of a plurality of apertures 31 vertically spaced apart and extending through each post 17.

Figure 2:
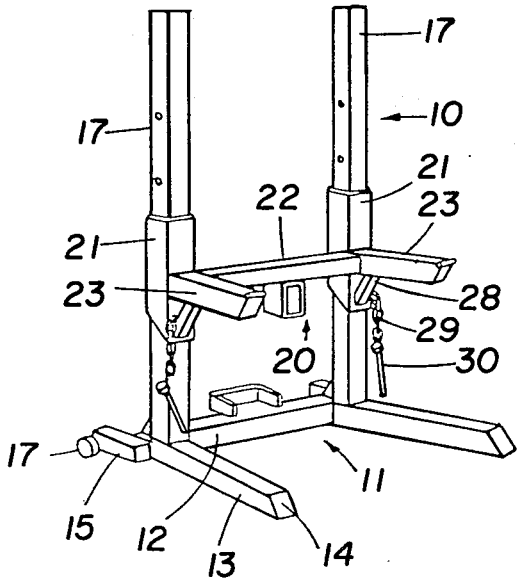
FIG. 2 is a perspective view of the jackable prop or stand of FIG. 1 in combination with a jacking means.
Figure 3:
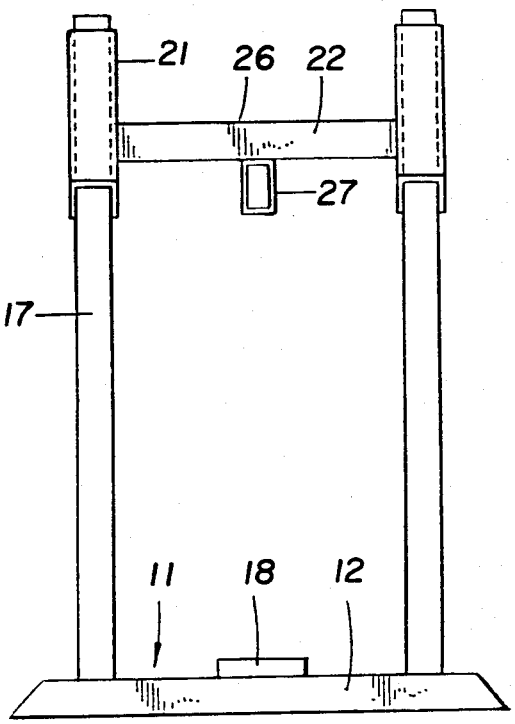
FIG. 3 is a front elevational view of the jackable prop or stand of FIG. 1.
Figure 4:
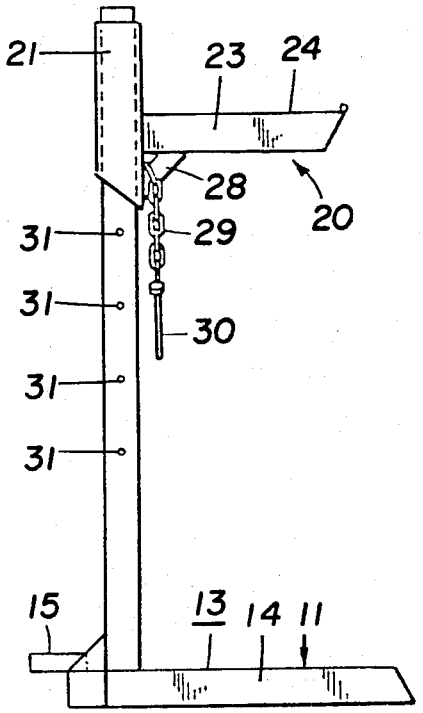
FIG. 4 is a side elevational view of the jackable prop or stand of FIG. 1.

As seen in FIG. 2, an elevating means, e.g. a manually operable jack 40 either a mechanical or an hydraulic jack is disposed on the jackable prop or stand 10 to raise the lifting frame 20. The base of the jack 40 rests on the step 18, while the lifting arm of the jack engages the engagement member 27. Any conventional jacking elevating means which is able to engage both the step 18 and the lifting frame 20 may be used, even if this means having the step on the front of the transverse bar.

Generalized Description

While the embodiment shown is constructed of hollow square beams, e.g. of steel, only the bushings and the posts need be of the same cross-section. While this is shown to be square, any other polygonal cross-section cross-section may be used. Moreover the transverse bars and the lifting bars may be of other profile, e.g. of "T"-beam or "I"-beam form. The various components may suitably be welded together.

OPERATION OF PREFERRED EMBODIMENTS

Figure 5:
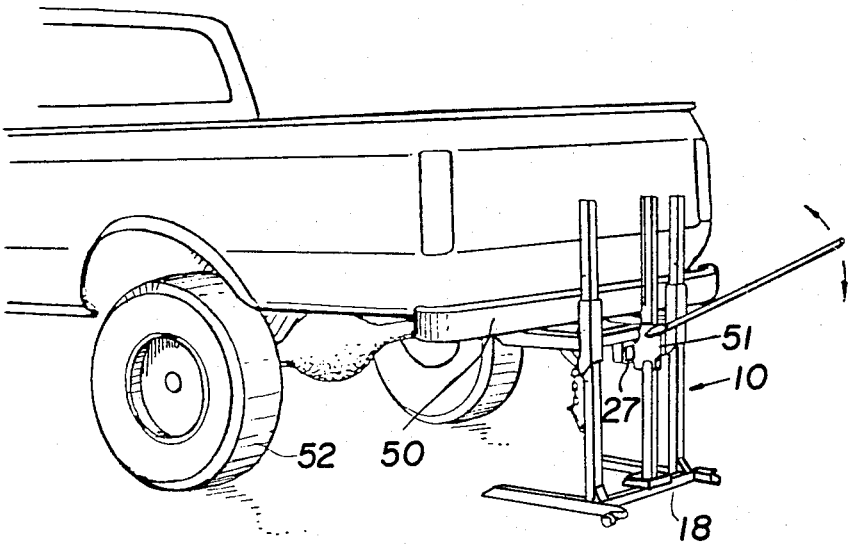
FIGS. 5–7 show the steps used in lifting the rear end of a truck off the ground using the jackable prop or stand of an embodiment of this invention.
Figure 6:
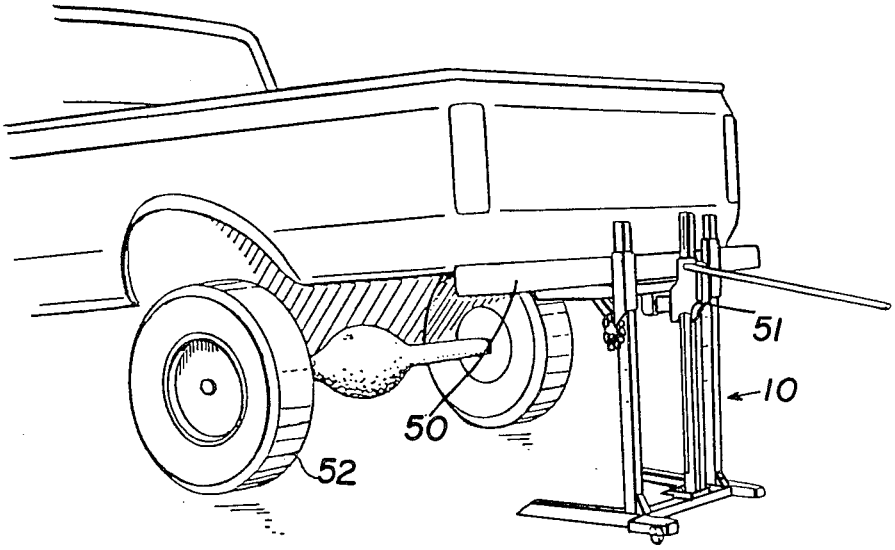
Figure 7:
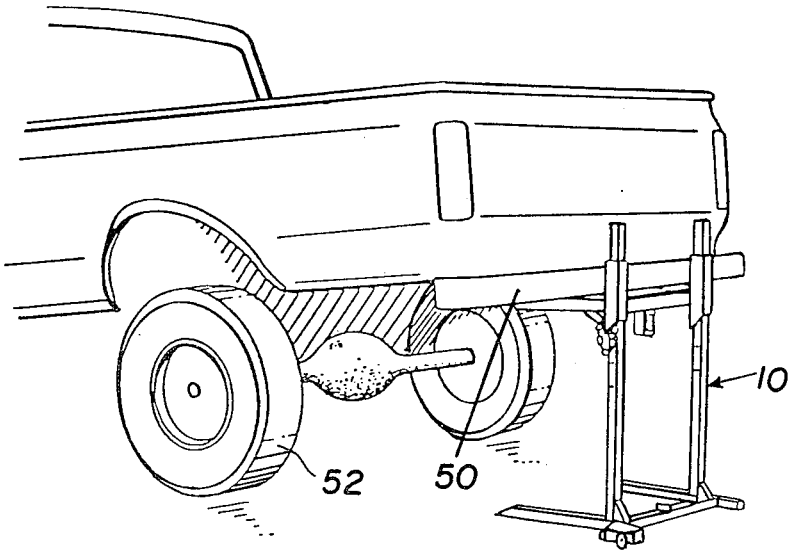

Description of FIGS. 5–7

In operation, in one version as shown in FIGS. 5–7, the jackable prop or stand 10 is first placed under the rear bumper 50. A jack 51 is then placed in association with the step 18 and the engagement member 27 and the jack 51 operated manually until the truck wheels 52 are off the ground. The pins 30 are then placed in the nearest hole 31 in the respective post 17 and the jack 51 lowered until the lifting frame 20 is supported on the pins 30. Then the jack 51 may be removed.

Figure 8:
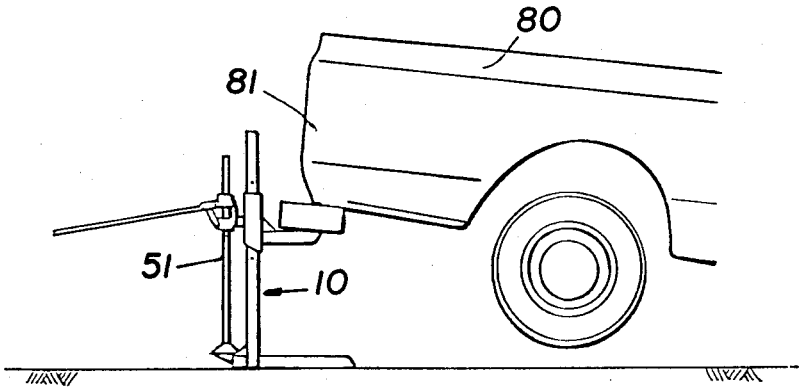
FIGS. 8–9 show the steps used in lifting a truck completely off the ground using the jackable prop or stand of an embodiment of this invention.
Figure 9:
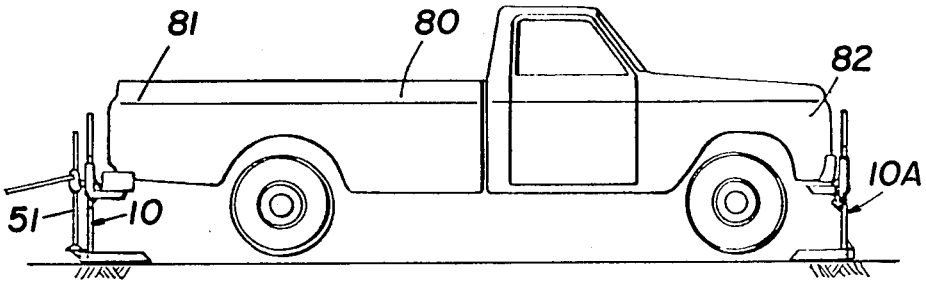

Description of FIGS. 8 and 9

FIGS. 8 and 9 show similar method for lifting a truck 80 completely off the ground. After the rear end 81 of the truck 80 has been raised off the ground and supported by the jackable prop or stand 10 of an aspect of this invention, using the jack as described for FIGS. 5–7, the jack 51 is used a second time to raise the front end 82 of the truck 80 onto a second jackable prop or stand 10A of an aspect of this invention. The drawings show the jack 51 still associated with the jackable prop 10.

Figure 10:
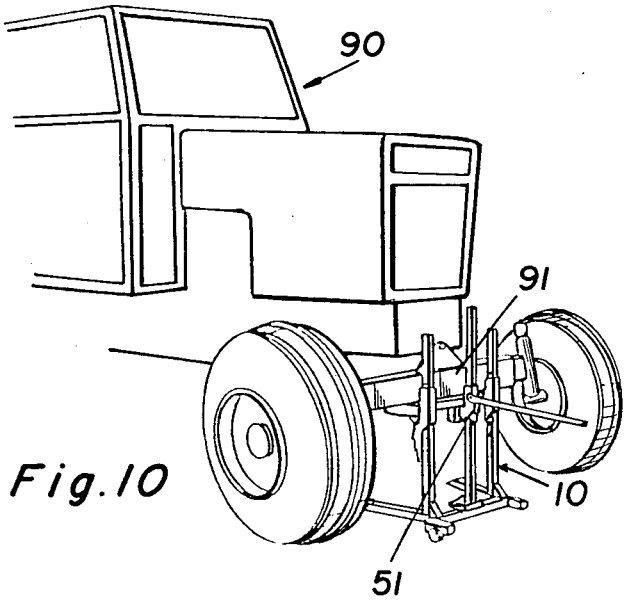
FIG. 10 shows the use of the jackable prop or stand of an embodiment of this invention to lift the front end of a tractor off the ground.

Description of FIG. 10

FIG. 10 shows the versatility, strength and balance of the jackable prop or stand 10 of an embodiment of this invention used to lift the front end 91 of a tractor 90 off the ground.

SUMMARY

From the foregoing, it will be apparent that the present invention provides a simple and inexpensive form of jackable prop or stand. The fact that the adjusting mechanism is detachable from the elevating device per se is of considerable importance as it renders the jackable prop or stand useful with either a mechanical or hydraulic jack.

Because of its broad stance on fairly long forwardly extending feet, the jackable prop or stand 10 of aspects of this invention may be used for other purposes. For example, although not shown in the drawings, it may be used as a work stand, and is most convenient since its work-supporting surface may be raised or lowered to a suitable working height. In addition, it may be used as scaffold bases since, again, its supporting surface may be raised or lowered to any desired height. The broad stance and long forwardly extending feet provide enhanced stability.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A jackable prop comprising:

(a) a base, including a transverse plate, and a pair of widely spaced-apart, forwardly-projecting, feet;

(b) a pair of spaced-apart, posts each having a polygonal cross-section upstanding from said base;

(c) a freely-vertically-movable lifting frame, slidably but not relatively rotatably mounted on said posts, said lifting frame comprising:

(i) a pair of bushings, each having a similar polygonal cross-section, each bushing having a length-to-width ratio of at least about 4-to-1 and being freely but not relatively rotatably slidably mounted on a respective said post, each said bushing thus being precluded from slewing with respect to its associated said post and also being inhibited from twisting and jamming when sliding with respect to its associated said post;

(ii) a transverse bar interconnecting said bushings;

(iii) a pair of forwardly projecting load bearing lifting arms; and (iv) engagement means secured to said transverse bar, said engagement means being adapted to be engaged by disengageable operable elevating means, whereby operation of said disengageable elevating means causes said transverse bar, and hence said load-bearing lifting arms, to be raised against a load applied directly thereon; and (d) manually operated means independent of said elevating means and cooperating between each said bushing and each said associated upstanding post for holding said lifting frame at a predetermined raised vertical position on each associated said post after said lifting frame has been so raised and upon disengagement and removal of said elevating means out of engagement with said engagement means.

2. The jackable prop of claim 1 wherein said upstanding posts are secured to said transverse plate at the region of said forwardly projecting feet.

3. The jackable prop of claim 1 wherein said upstanding posts are each secured to a respective, forwardly-projecting, foot.

4. The jackable prop of claim 1 wherein said lifting frame includes a lifting arm projecting forwardly from each said bushing.

5. The jackable prop of claim 1 wherein said lifting frame includes a pair of spaced-apart lifting arms projecting forwardly from said transverse bar.

6. The jackable prop of claim 1 wherein said engagement means comprises a hollow engagement member on the lower surface of said transverse bar.

7. The jackable prop of claim 1 wherein said holding means comprises the combination of a plurality of vertically spaced-apart apertures through said bushings, and through said posts, and a pin adapted to be inserted through respective aligned said apertures.

8. The jackable prop of claim 1 including fixed heels projecting rearwardly from the rear of said transverse plate to assist in stabilizing said prop.

9. The jackable prop of claim 1 including rotatable wheels projecting rearwardly from the rear of said transverse plate, both to assist in stabilizing said prop and to enable it to be more easily moved.

10. The jackable prop of claim 1 wherein said cross-section is square.

11. The jackable prop of claim 1 wherein all elements are of hollow square cross-section.

12. The jackable prop of claim 1 including a lower step adapted to support the base of an elevating means.

13. The jackable prop of claim 12 wherein said disengageable elevating means is included in combination with said jackable prop, said elevating means being removably disposable between said step and said engagement means for raising said lifting frame relative to said base.

14. The jackable prop of claim 13 wherein said elevating means is a mechanical jack.

15. The jackable prop of claim 13 wherein said elevating means is an hydraulic jack.

* * * * *